US006929077B2

(12) United States Patent
Brolund

(10) Patent No.: US 6,929,077 B2
(45) Date of Patent: Aug. 16, 2005

(54) BORING HEAD, ROLLER CUTTER AND SADDLE FOR A BORING HEAD FOR ROTARY DRILLING

(75) Inventor: Stig-Ake Brolund, Sandviken (SE)

(73) Assignee: Sandvik AB, Sandviken (SE)

( * ) Notice: Subject to any disclaimer, the term of this patent is extended or adjusted under 35 U.S.C. 154(b) by 143 days.

(21) Appl. No.: 10/315,100

(22) Filed: Dec. 10, 2002

(65) Prior Publication Data

US 2003/0106720 A1 Jun. 12, 2003

(30) Foreign Application Priority Data

Dec. 10, 2001 (SE) ..... 0104138

(51) Int. Cl.[7] ..... E21B 10/10
(52) U.S. Cl. ..... 175/364; 175/53
(58) Field of Search ..... 175/53, 364, 363, 175/367, 368, 369, 360, 361

(56) References Cited

U.S. PATENT DOCUMENTS 3,601,207 A 8/1971 Coski
3,612,196 A 10/1971 Dixon
3,835,944 A * 9/1974 Bingham ..... 175/364
3,836,271 A 9/1974 Coski
4,448,271 A 5/1984 Persson
5,487,435 A * 1/1996 Crawley et al. ..... 175/363
5,984,024 A 11/1999 Strand

* cited by examiner

*Primary Examiner*—David Bagnell
*Assistant Examiner*—K. Thompson
(74) *Attorney, Agent, or Firm*—Burns, Doane, Swecker & Mathis, LLP

(57) ABSTRACT

A raise boring head includes a roller cutter body and a saddle intended for rotary drilling in earth and rock formations. The roller cutter body is rotatably journalled on a shaft that is provided with two shaft spigots at its opposite ends. Each spigot has a second support surface provided for cooperation with a first support surface of the saddle to hold the roller cutter to the saddle. Each shaft spigot is provided with a hole for receiving a fastener that also passes through the second support surface in order to connect the shaft spigot to the saddle. The first support surface and the second support surface are curved. The first support surface and the second support surface connect directly or indirectly to stop shoulders for counteracting rotation of the shaft. The fastener is eccentric to the shaft axis and arranged to press the stop surfaces together.

17 Claims, 8 Drawing Sheets

BORING HEAD, ROLLER CUTTER AND SADDLE FOR A BORING HEAD FOR ROTARY DRILLING

This application claims priority under 35 U.S.C. §119 to Patent Application Ser. No. 0104138-3 filed in Sweden on Dec. 10, 2001, the entire content of which is incorporated by reference.

BACKGROUND OF THE INVENTION

The present invention relates to a boring head and a roller cutter and a saddle for a boring head for rotary drilling of a front in earth and rock formations.

PRIOR ART

A roller cutter for a known boring head is held in a saddle via polygonal shaft spigots of the roller cutter, see for example Persson U.S. Pat. No. 4,448,271. The great drilling forces that influence the known boring head frequently break one shaft spigot of each roller cutter.

OBJECTS OF THE INVENTION

One object of the present invention is to provide a boring head and a roller cutter and a saddle, the designs of which assist in obtaining longer production periods.

Another object of the present invention is to provide a durable roller cutter. Still another object of the present invention is to provide a roller cutter and a saddle, the designs of which prevent loosening relative to each other.

SUMMARY OF THE INVENTION

These and other objects have been obtained by a boring head for rotary drilling in earth and rock formations. The boring head comprises a main body having a mounting surface and at least one saddle carried by the main body. The saddle includes a pair of spaced apart legs, each leg having a first curved support surface and a first hole extending through the first curved support surface. A shaft is provided having a longitudinal axis and including spigots at its opposite ends. The spigots are mounted in respective legs. Each spigot includes a second curved support surface seated on a respective first curved support surface. Each spigot is provided with a second hole formed therein. Each spigot and its associated leg have interengaging stop surfaces for preventing rotation of the shaft relative to the legs in one direction about the longitudinal axis of the shaft, wherein the first hole of each spigot is aligned with the second hole of its respective leg when the stop surfaces are engaged. A fastener extends through each first hole and its associated second hole for holding the stop surfaces together. A rotary cutter body is rotatably journalled on the shaft.

The invention is also directed to the concept of orienting the fastener such as to apply a force to the shaft in a direction which causes the stop surfaces to be pressed together.

Another feature of the invention relates to a roller cutter which comprises a main body having a mounting surface and at least one saddle carried by the main body. A shaft defines a longitudinal axis and includes spigots at its opposite ends, each spigot including a curved support surface seated on the saddle and a hole extending through the support surface. A fastener extends through the hole for securing the shaft to the saddle. The shaft and the saddle define interengaging stop surfaces for resisting rotation of the shaft about its longitudinal axis. A rotary cutter body is rotatably journalled on the shaft.

The invention also pertains to a saddle for rotatably securing a rotary cutter body on a boring head. The saddle comprises a pair of legs, each leg including first and second arms together forming a curved supporting surface. A hole is formed in each leg and extends through the support surface and is adapted to receive a fastener. Each leg includes a shoulder forming a stop surface disposed at an end of the respective supporting surface.

DESCRIPTION OF A PREFERRED EMBODIMENT OF THE INVENTION

Figure 1:
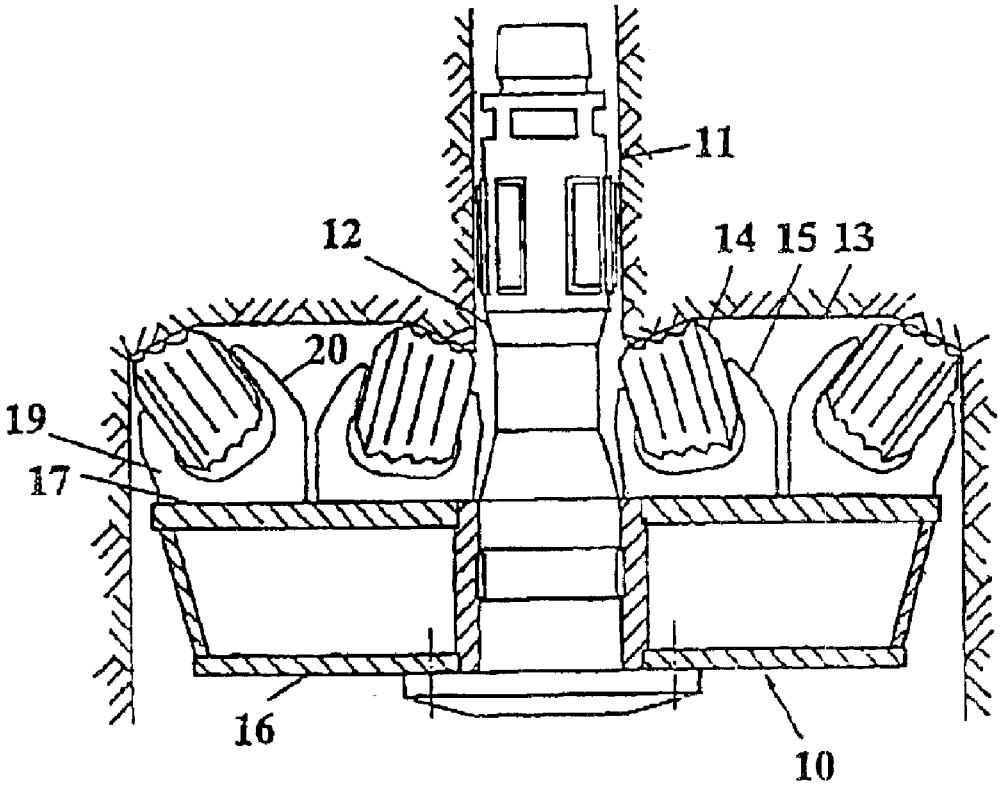
FIG. 1 shows an axial cross-section through a reaming head for raise boring having roller cutters and saddles according to invention.

In FIG. 1 is shown how a pilot hole 11 is pre-drilled in a conventional manner between upper and lower levels, not shown, in a mine. The hole 11 is reamed by means of a reaming head depicted by the reference numeral 10. The reaming head 10 is attached to a drive stem 12 by means of which the reaming head is rotated and forced against an annular surface 13 which surrounds the pilot hole 11. The surface 13, thus, defines the face of the earth formation.

The invention generally relates to earth drilling, but is primarily intended for raise boring. During raise boring, a distance between the lower and the upper level of the mine is drilled in a mine to form a pilot hole, whereafter the pilot hole is reamed by means of a large diameter boring head.

The boring head 10 comprises a main body 16 and a plurality of roller cutters or cutters 14, which are mounted on the main body in attachments or saddles 15. Each roller cutter comprises a rotary body 14*a* carrying circumferential rows of buttons or crushing means of hard metal in a known manner. The rotary body 14*a* is rotatably journalled on a shaft 33 which is mounted on the saddles 15. The saddles 15 are assembled on the body 16. The drive stem 12 is connected to the body 16.

Figure 2A:
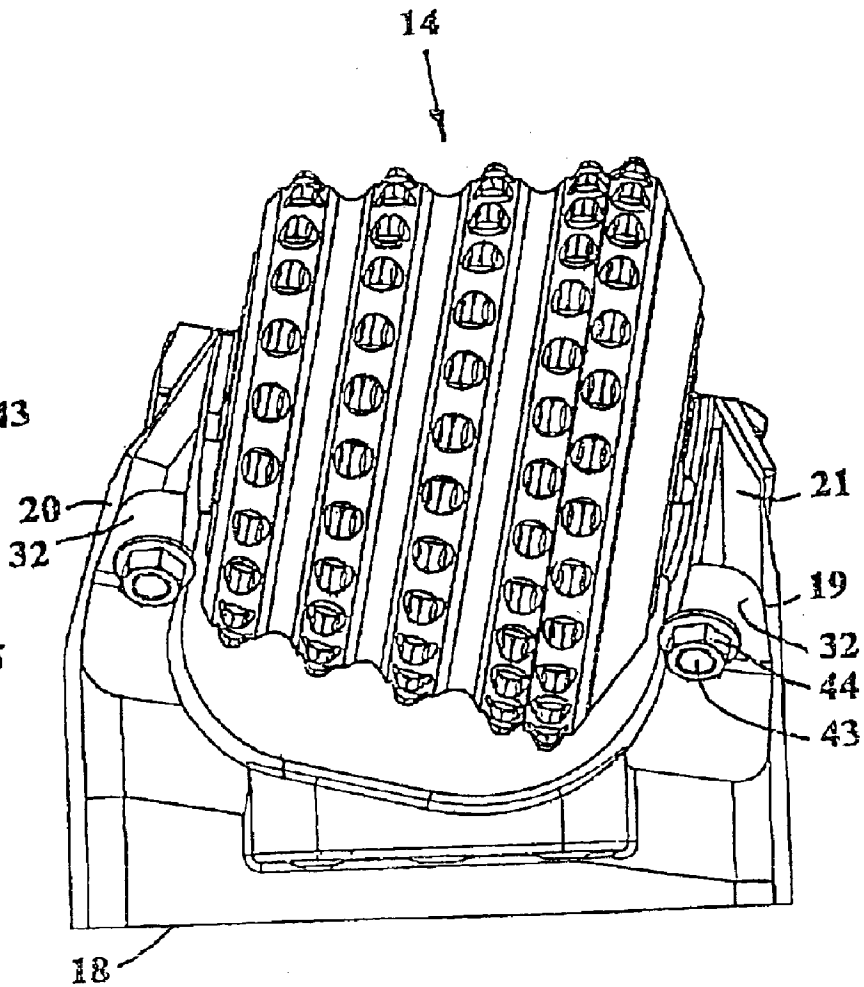
FIG. 2A shows the roller cutter and a saddle according to the present invention in a side view of the reaming head of FIG. 1.
Figure 2B:
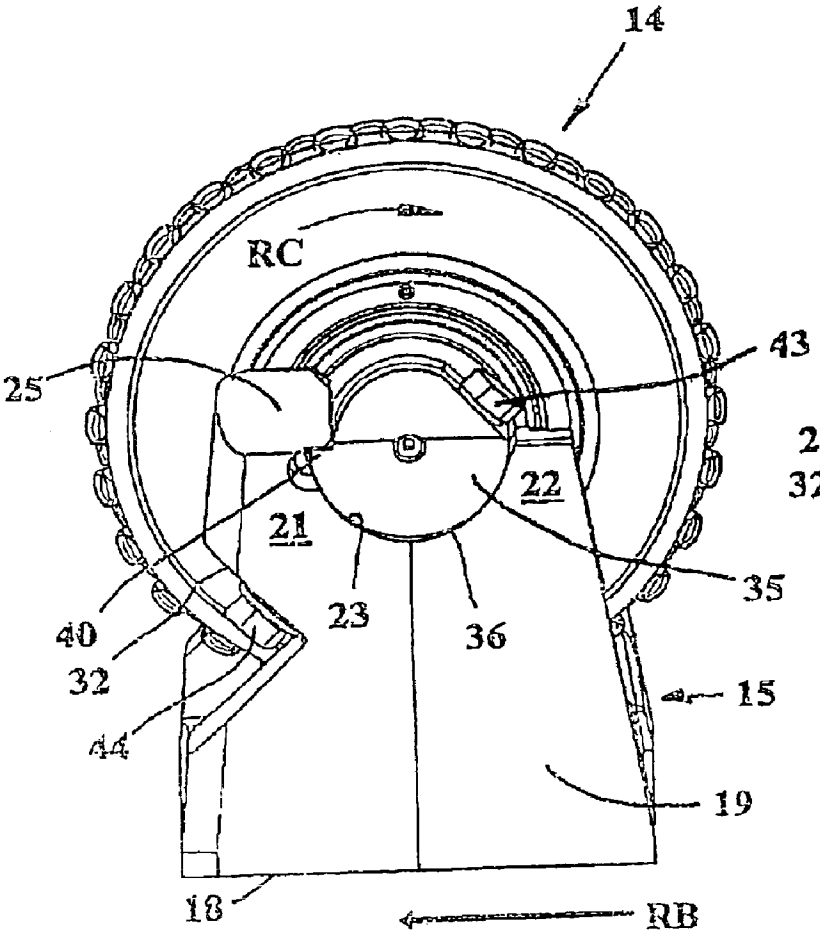
FIG. 2B shows a first end view of the roller cutter and the saddle according to the invention.
Figure 2C:
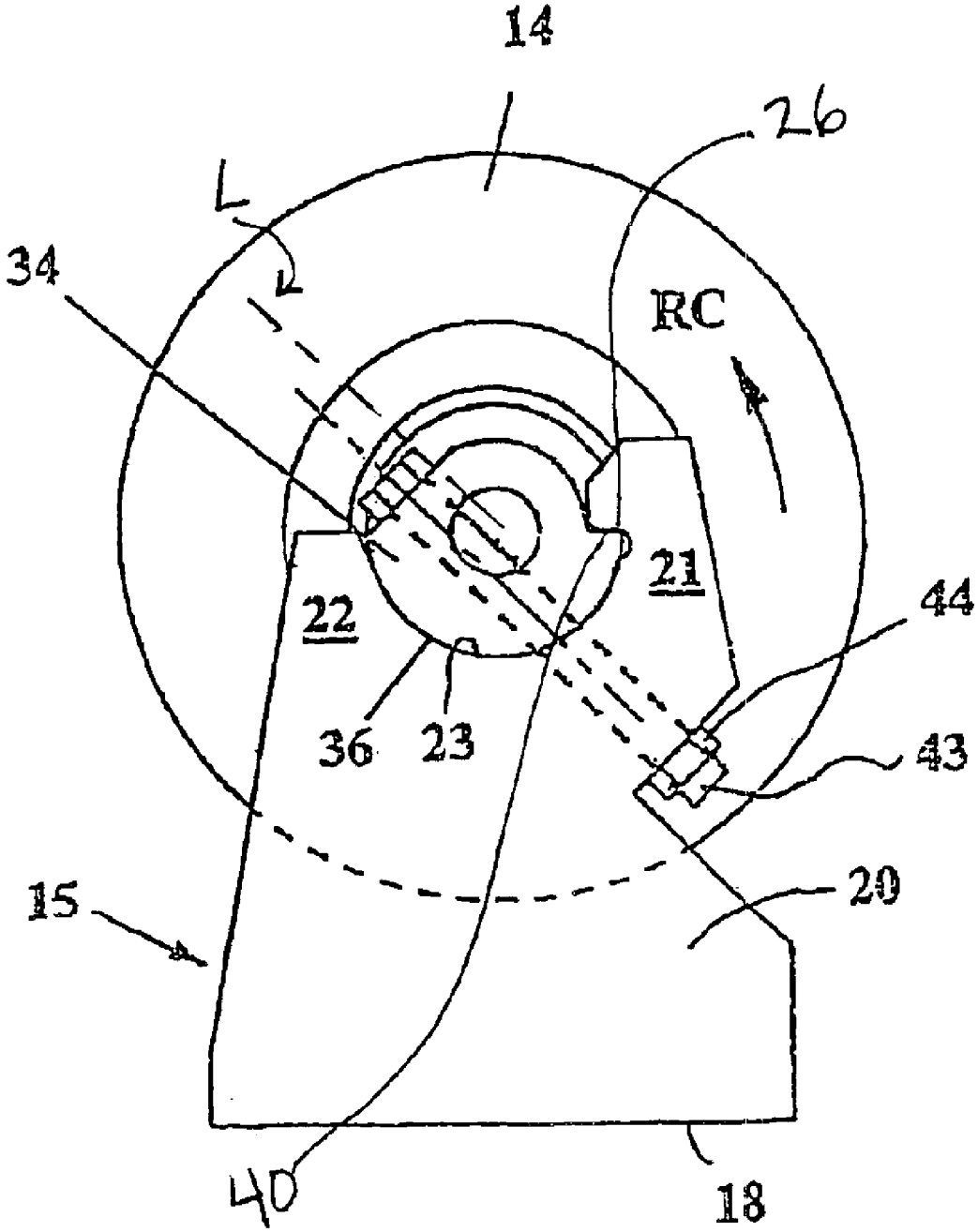
FIG. 2C schematically shows a second end view of the roller cutter and the saddle opposite to the end view of FIG. 2B.
Figure 3A:
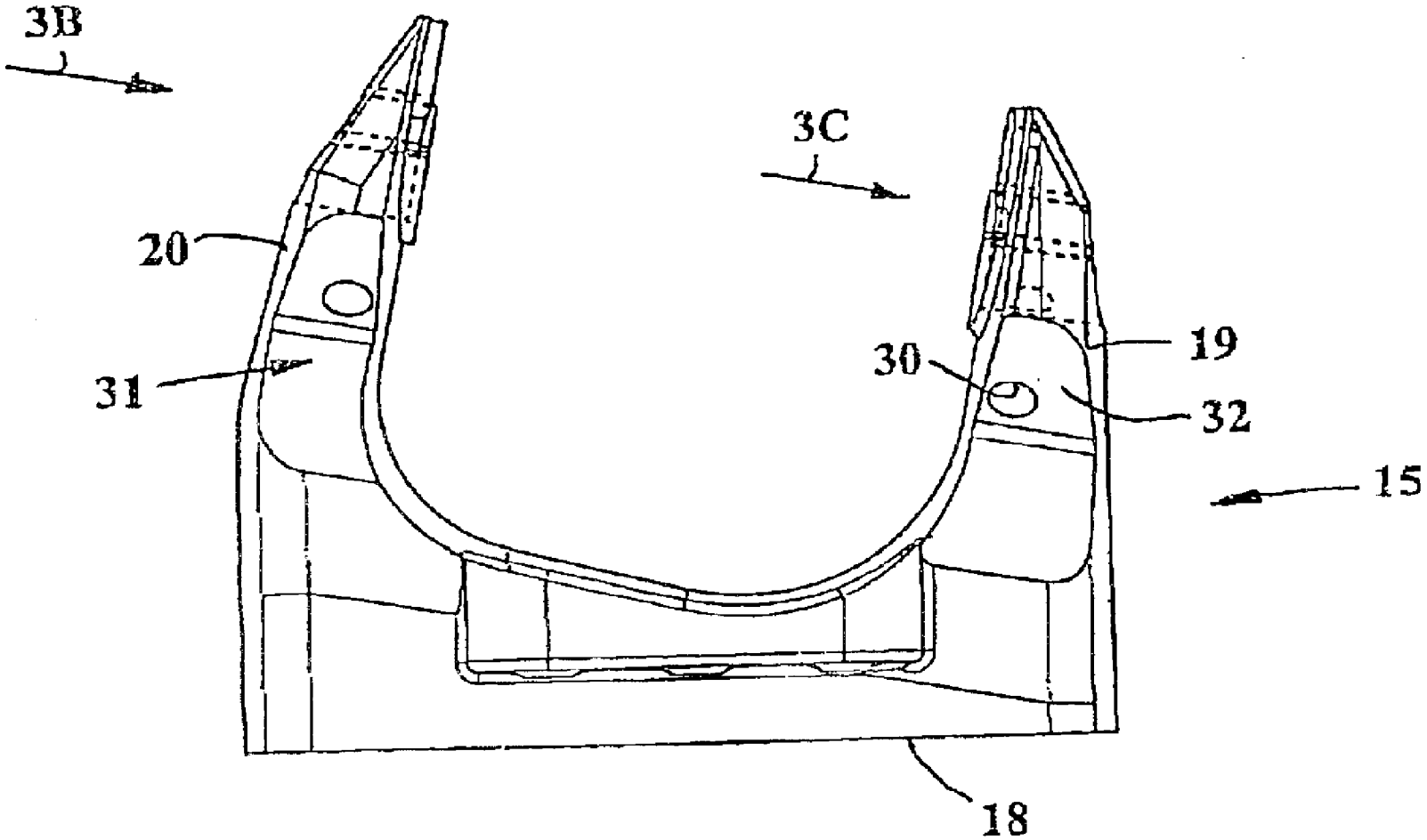
FIG. 3A shows a saddle according to the present invention in a side view.
Figure 3B:
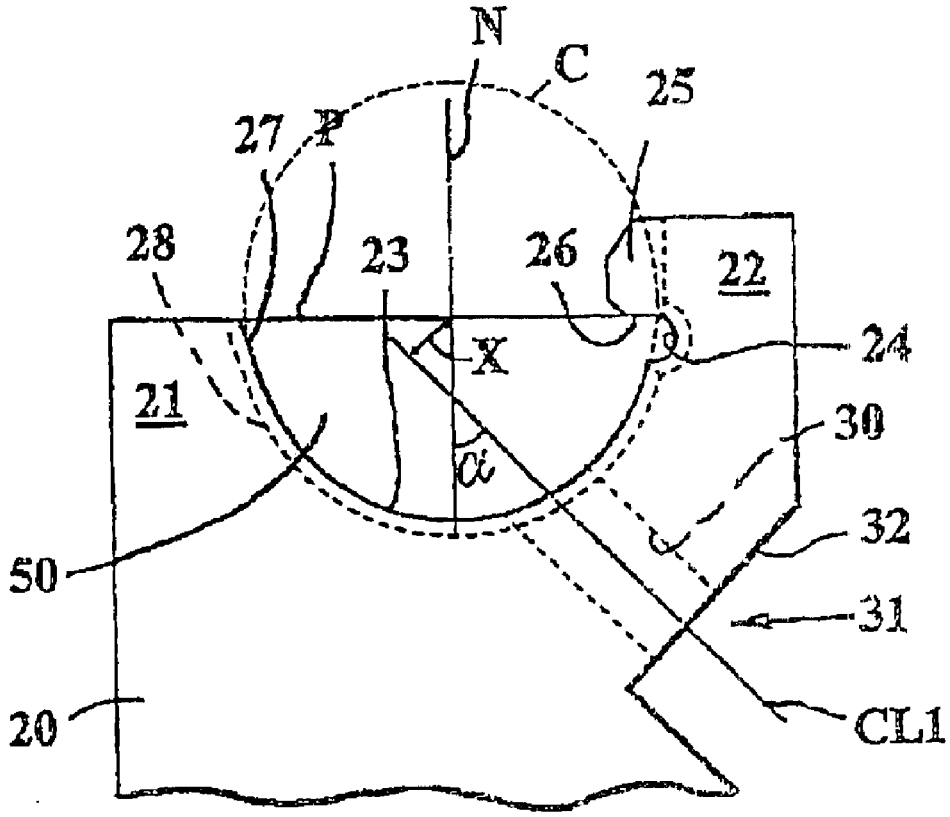
FIGS. 3B and 3C show the saddle in opposed end views according to the arrows 3B and 3C, respectively, in FIG. 3A.
Figure 3D:
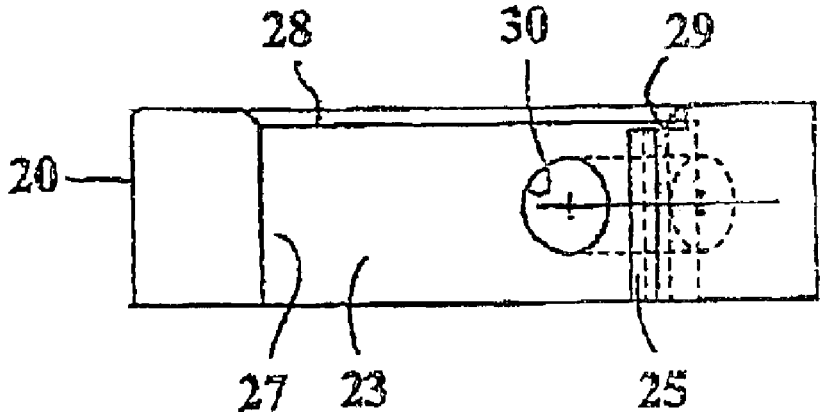
FIGS. 3D and 3E show top views of the ends of the saddle corresponding to FIGS. 3B and 3C, respectively.
Figure 3C:
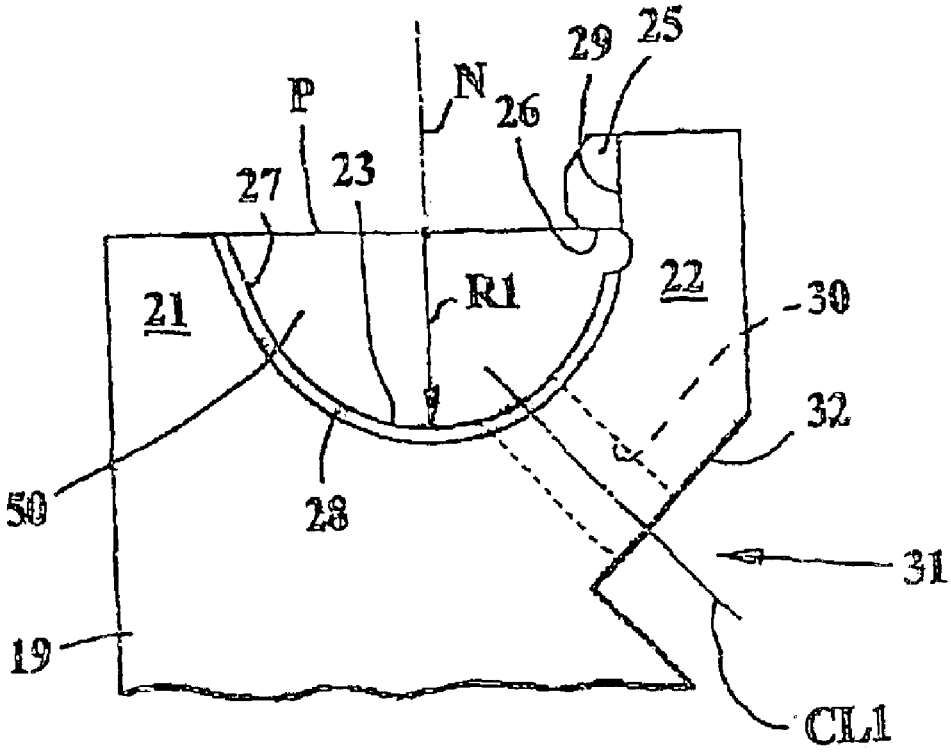
Figure 3E:
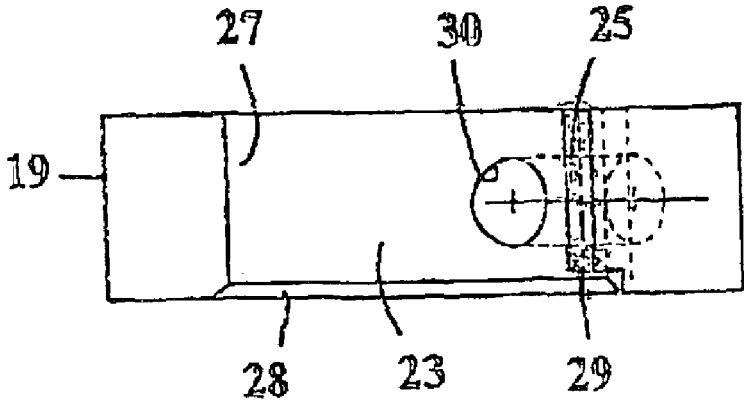
Figure 4A:
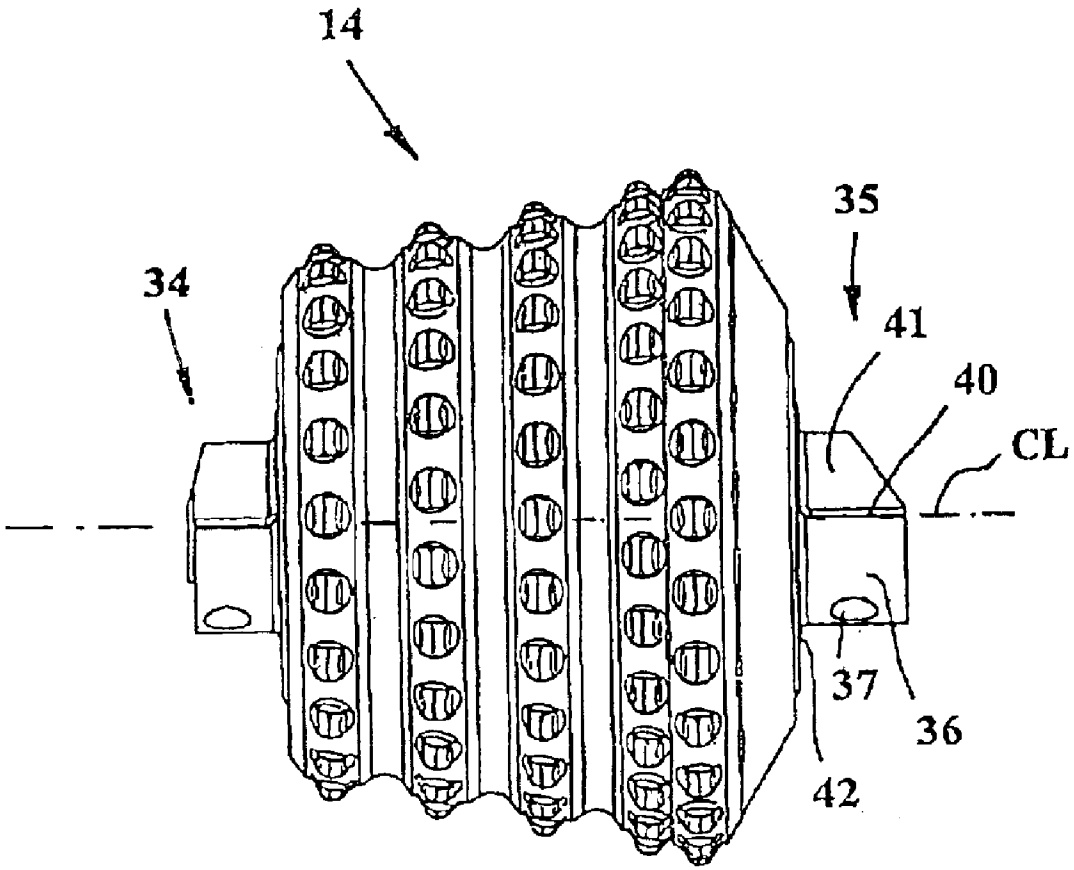
FIG. 4A shows the roller cutter according to the present invention in a side view.
Figures 4B, 4C, 4D, 4E:
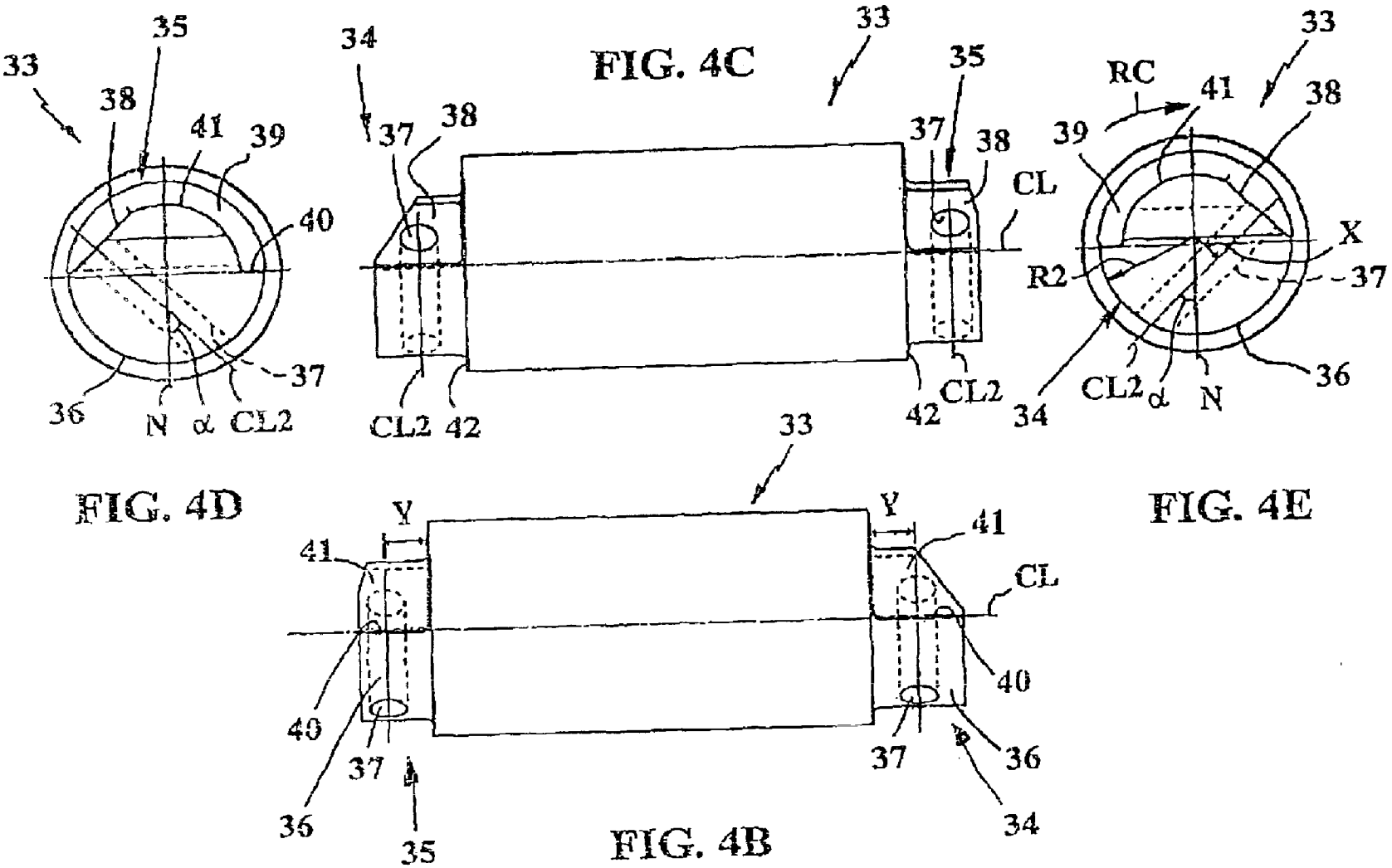
FIG. 4B shows a shaft for the roller cutter of FIG. 4A according to the present invention in a side view.
FIG. 4C shows the shaft for the roller cutter in an additional side view.
FIGS. 4D and 4E show the shaft in respective opposite end views.

The body 16 is provided with a mounting face 17 on which the saddles 15 are carried. The saddle 15 comprises a bottom surface 18 which is adapted to be connected to the mounting face 17, for instance by bolting or welding. The saddle 15 further comprises two legs 19, 20 between which the roller cutter 14 is mounted. Each of the legs 19, 20 is provided with two arms 21, 22 or 21', 22' at the end thereof opposite to the bottom surface 18. As shown in FIG. 2C, the arms 21, 22 having different lengths measured from the bottom surface 18, i.e. The arm 21 which leads in the rotational direction RB of the boring head (see FIG. 2B) is longer than the trailing arm 22. Each pair of arms 21, 22 forms a recess 50 and each recess has a concavely curved support surface 23, which is at least partly circular or cylindrical. A line N passes through the geometric center CL of the surface 23 and also through a midpoint of the surface 23 (see FIG. 3B). The support surface 23 connects forwardly in the rotational direction RC of the roller cutter 14 via a fillet 24 to a shoulder or collar 25. The fillet 24 comprises a concave recess intended to reduce the risk for crack formation at the area between the support surface 23 and the shoulder 25. The shoulder 25 projects inside an imaginary circle C that touches or wholly or partly coincides with the support surface 23, see FIG. 3C.

The shoulder 25 comprises a stop surface 26, which is substantially parallel with a plane P intersecting the rotational axis of the roller cutter. The support surfaces further connect to a bevel 27, which substantially follows a tangent to the support surface 23 at the end which is provided essentially diametrically opposed to the fillet or the shoulder. The bevel 27 expands the space at the support surface 23 and is intended to facilitate entering of the shaft spigot of the roller cutters 14 into the saddle. The inside of each leg 19, 20 is provided with clearances, such as a chamfer 28 and a recess 29, to avoid contact with the shaft spigots of the roller cutter. A first through-hole 30 is provided in each leg, which in the shown embodiment ports in the support surface 23 on the same side of the normal N as the shoulder 25 is arranged. The hole 30 is provided at the mid area of the axial length of the support surface (see FIG. 3D). The hole 30 has a center line CL1 which in the shown embodiment may form an angle $\alpha$ up to 60° with the normal N, the hole porting (penetrating) in a wall 32 of a recess 31 preferably on the same side of the normal N as the shoulder 25 is arranged. Alternatively, the center line CL1 could extend parallel to the normal N, and thus a recess would be developed centrally in the saddle to receive a nut, not shown. The center line CL1 of the hole 30 does not intersect the rotational axis CL of the roller cutter defined by the shaft's longitudinal axis but extends offset therefrom at a perpendicular distance X from the rotational axis of the roller cutter. The distance X is 10–50% of a radius R1 of the support surface 23. The offset is in a direction causing a fastener to rotate the shaft counterclockwise in FIG. 2C as will be explained.

The roller cutter 14 comprises a shaft 33 (see FIGS. 4A–4E), the ends of which forming respective shaft spigots 34 and 35, each having a substantially cylindrical or convexly curved support surface 36, which is intended to abut against the support surface 23 in the saddle. The support surface 36 extends circumferentially approximately 180°. The shaft spigot 34, 35 is provided with a second through hole 37, which intersects a planar surface 38 of the spigot as well as the convexly curved support surface 36. The support surface 36 connects to a recess 39 forwards in the rotational direction RC of the roller cutter 14. The recess 39 forms an inwardly directed collar 40 and a cylindrical, convex free surface 41 of the spigot. The collar 40 constitutes a stop surface, as will be explained, which stop surface 40 extends inwardly from the surface 36 and generally toward the longitudinal axis of the shaft 33. The stop surface 40 faces in a direction oriented generally tangentially considered with reference to the longitudinal axis of the shaft 33. The free surface 41 is disposed closer to the shaft's longitudinal axis than is the support surface 36. The center axis of the hole 37 and the stop surface 40 are located on respective opposite sides of an imaginary line L that passes through the shaft's longitudinal axis parallel to the center axis of the hole 37.

The collar 40 extends inside of the imaginary circle C which coincides with the support surface 36. The collar 40 is substantially plane-parallel with the bottom surface 18 of the saddle. The free surface 41 is intended to form a space for the shoulder 25 such that the shaft will be able to rotate about 45° in the saddle. The planar surface 38 is intended to constitute a support for the head of a bolt at mounting of the cutter to the saddle. The second through hole 37 is provided in each shaft spigot 34, 35, and it ports in the support surface 36 on the same side of the normal N as the collar 40 is arranged. The hole 37 has a center line CL2 which forms an angle $\alpha$ with the normal N and ports in the support surface 36 on the same side of the normal N as the collar is arranged. The angle $\alpha$ is no greater than 60°.

Alternatively, the center line CL2 could coincide with the normal N (i.e., $\alpha$ would be zero). If $\alpha$ is greater than zero, the center line CL2 of the hole 37 does not intersect the rotational axis CL of the roller cutter but extends below this at a perpendicular distance X from the rotational axis of the roller cutter. The distance X is 10–50% of a radius R2 of the support surface 36. The radii R1 and R2 are essentially alike. The center line CL2 of the hole 37 in both shaft spigots 34, 35 is provided in axial direction at a certain distance Y from a root 42 of the spigot. The shaft spigot 35 is however somewhat shorter than the shaft spigot 34 such that the roller cutter 14 will be able to be positioned in an optional saddle on the boring head.

Mounting the roller cutter 14 to the saddle 15 is done as follows foremost with reference to FIGS. 2A–2C. The saddle 15 is attached to the boring head 10. The roller cutter 14 which weighs about 125 kg is lifted and the shaft 33 is rotated such that the diameter of each shaft spigot 24, 35 in the plane P becomes smaller than the opening between the shoulder 25 and the bevel 27 in the saddle. Thereby the shaft 33 can be lowered into the saddle until the support surface 36 abuts against the support surface 23. At said lowering, the center line CL2 for the hole 37 can be held vertically, but the angle of the center line CL2 may vary relative to the center line CL1 for the hole 30 since it is sufficient to make sure that the shaft's 33 biggest dimension in the plane P (defined by the end of the bevel 27 and the stop surface 26) is smaller than the smallest dimension of the recess 50 in the plane P. The support surface 23 is defined by a radius R1, the center of which lies in the plane P, essentially at the rotational axis CL. Consequently, the angle of the center line CL2 can vary within the interval from 20° to the left of the normal N to about 30° to the right of the normal N.

Subsequently, the shaft spigots are rotated in the rotational direction RC of the roller cutter by hand or by means of a lever inserted into the hole 37, such as a threaded bolt 43. During said rotation there exists a gap between the surface 41 and the shoulder 25. The shaft spigots are rotated about the rotational axis CL until a stop surface defined by the collar abuts against the stop surface 26 of the shoulder 25. The collar 40 and the shoulder 25 can also be called means for counteracting rotation of the shaft 33. The means 25, 40 is provided on only one side of the normal N. the bolt abuts against the surface 38, possibly via a washer, not shown. Thereby the threaded other end of the bolt projects into the recess 31, such that a nut 44 can be screwed along said end and such that the connection can be tightened. The bolt 43 will thus run eccentrically relative to the rotational axis CL, and therefore a force will substantially constantly keep the stop surface of the collar 40 and the stop surface 26 of the shoulder 25 pressed together. The bolt 43 forms an angle with the normal N, which can have a value up to 60°.

Even if the bolt should break or loosen during drilling, rotation forces generated by the rotary cutter body 14*a* in direction RC will retain contact between the stop surface of the collar 40 and the stop surface 26 of the shoulder 25 such that the roller cutter will be retained in the saddle. The eccentric placement of the bolt 43 causes the shaft 33 to rotate during tightening and therefore the shaft is pre-stressed against the shoulder 25.

The shaft 33 preferably has an internal cavity intended to form a space for infeed of balls to roller bearings and to receive a lubrication device and a stopper means, such as described in U.S. Pat. No. 5,984,024, which is hereby incorporated in the present description.

Thus the present invention relates to a boring head and a roller cutter and a saddle for a boring head for rotary drilling of a front in earth and rock formations the designs of which assist in obtaining longer production periods by means of more durable roller cutters and the designs of which prevent loosening relative to each other even if the fastening means gets loose.

Although the present invention has been described in connection with preferred embodiments thereof, it will be appreciated by those skilled in the art that additions, modifications, substitutions and deletions not specifically described may be made without departing from the spirit and scope of the invention as defined in the appended claims.

What is claimed is:

1. A boring head for rotary drilling in earth and rock formations comprising:

a main body having a mounting surface and at least one saddle carried by the main body, the saddle including a pair of spaced apart legs, each leg having a first curved support surface and a first hole extending through the first curved support surface;

a shaft defining a longitudinal axis and including spigots at its opposite ends, the spigots being mounted in respective legs, each spigot including a second curved support surface seated on a respective first curved support surface, each spigot provided with a second hole formed therein;

each spigot and its associated leg having interengaging stop surfaces for preventing rotation of the shaft relative to the legs in one direction about the longitudinal axis of the shaft, wherein the first hole of each spigot is aligned with the second hole of its respective leg when the stop surfaces are engaged;

a fastener spaced from the stop surfaces and extending through each first hole and its associated second hole aligned therewith for holding the stop surfaces together; and a rotary cutter body rotatably journalled on the shaft.

2. The boring head according to claim 1, wherein one of the stop surfaces is defined by a shoulder of the leg, and the other stop surface is defined by a collar on the shaft, the stop surfaces lying inside of an imaginary circle which touches the support surfaces.

3. The boring head according to claim 2 wherein the imaginary circle coincides with the curved support surfaces.

4. The boring head according to claim 1 wherein the fastener is oriented for applying a force to the shaft in a direction to press the stop surfaces together.

5. The boring head according to claim 4 wherein the fastener comprises a threaded bolt.

6. The boring head according to claim 5 wherein the stop surfaces are located on one side of a line extending through both the shaft longitudinal axis and a midpoint of the first curved support surface.

7. The boring head according to claim 1 wherein the stop surfaces are situated at an end of the respective curved support surfaces.

8. A boring head for rotary drilling in earth and rock formations comprising:

a main body having a mounting surface and at least one saddle carried by the main body, the saddle including a pair of spaced apart legs, each leg having a first curved support surface;

a shaft defining a longitudinal axis and including spigots at its opposite ends, the spigots being mounted in respective legs, each spigot including a second curved support surface seated on a respective first curved support surface;

each spigot and its associated leg having interengaging stop surfaces for preventing rotation of the shaft relative to the legs in one direction about its longitudinal axis;

a fastener for holding the stop surfaces together and applying a force to the shaft directed to press the stop surfaces against one another; and a rotary cutter body rotatably journalled on the shaft.

9. A roller cutter comprising:

a main body having a mounting surface and at least one saddle carried by the main body, a shaft defining a longitudinal axis and including spigots at its opposite ends, each spigot including a curved support surface seated on the saddle and a hole extending through the support surface;

a fastener extending through the hole for securing the shaft to the saddle;

the shaft and the saddle defining interengaging stop surfaces spaced from the fastener for resisting rotation of the shaft about its longitudinal axis; and a rotary cutter body rotatably journalled on the shaft.

10. The roller cutter according to claim 9 wherein the saddle includes two curved supporting surfaces on which the supporting surfaces of the spigots are seated, the curved supporting surfaces on the spigots being curved in corresponding fashion to the curvature of the supporting surfaces of the saddle, the stop surfaces situated at the end of respective supporting surfaces.

11. The roller cutter according to claim 9 wherein the stop surfaces on the spigots are defined by collars, each collar disposed inside of an imaginary circle which coincides with the respective curved supporting surface of the spigots.

12. The roller cutter according to claim 9 wherein the hole defines a center axis which is offset from the longitudinal axis of the shaft in a direction causing the fastener to exert a force pressing the stop surfaces together.

13. A saddle for rotatably securing a rotary cutter body on a boring head, the saddle comprising a pair of legs, each leg including first and second arms together forming a curved supporting surface, a hole formed in each leg and extending through the curved supporting surface and adapted to receive a fastener, each leg including a shoulder forming a stop surface disposed at an end of the respective supporting surface, wherein the curved supporting surface defines a geometric center, the hole having an axis offset from the geometric center of the curved supporting surface.

14. The saddle according to claim 13 wherein the shoulder lies inside of an imaginary circle which coincides with the curved supporting surface.

15. The saddle according to claim 13 wherein the shoulder is disposed on one side of a line passing through both the center of the curved supporting surface and a midpoint of the curved supporting surface.

16. A boring head for rotary drilling in earth and rock formations comprising:

a main body having a mounting surface and at least one saddle carried by the main body, the saddle including a pair of spaced apart legs, each leg having a first curved support surface and a first hole extending through the first curved support surface;

a shaft defining a longitudinal axis and including spigots at its opposite ends, the spigots being mounted in respective legs, each spigot including a second curved support surface seated on a respective first curved support surface, each spigot provided with a second hole formed therein;

each spigot and its associated leg having interengaging stop surfaces for preventing rotation of the shaft relative to the legs in one direction about the longitudinal axis of the shaft, wherein the first hole of each spigot is aligned with the second hole of its respective leg when the stop surfaces are engaged;

a fastener extending through each first hole and its associated second hole aligned therewith for holding the stop surfaces together, wherein the fastener is oriented for applying a force to the shaft in a direction to press the stop surfaces together; and a rotary cutter body rotatably journalled on the shaft.

17. A roller cutter comprising:

a shaft defining a longitudinal axis;

spigots attached to respective ends of the shaft to be immovable relative to the shaft, each spigot having an outer periphery including:

a convexly curved support surface facing away from the longitudinal axis, a stop surface disposed adjacent one circumferential end of the support surface and extending inwardly therefrom generally toward the axis, the stop surface facing in a direction oriented generally tangentially with reference to the longitudinal axis, and a free surface disposed adjacent another circumferential end of the support surface, wherein the free surface is situated closer to the longitudinal axis than is the support surface, each spigot including a hole extending therethrough from the free surface to the support surface, wherein a center axis of the hole is offset from the longitudinal axis, wherein the center axis and the stop surface are disposed on respective opposite sides of an imaginary line passing through the longitudinal axis parallel to the hole's center axis; and a rotary cutter body rotatably journalled on the shaft.

* * * * *